United States Patent [19]

Adler

[11] 4,361,822

[45] Nov. 30, 1982

[54] MAGNETIC PALLET

[76] Inventor: David T. Adler, 110 Dumbarton Dr., Huntington, N.Y. 11743

[21] Appl. No.: 293,950

[22] Filed: Aug. 18, 1981

[51] Int. Cl.[3] ..... H01F 7/02

[52] U.S. Cl. ..... 335/303; 335/306

[58] Field of Search ..... 335/285, 286, 295, 302, 335/303, 306

[56] References Cited

U.S. PATENT DOCUMENTS 3,665,355 5/1972 Sasaki et al. ..... 335/306

3,942,147 3/1976 Josephson ..... 335/303

*Primary Examiner*—George Harris

*Attorney, Agent, or Firm*—Charles I. Brodsky

[57] ABSTRACT

A magnetic pallet incorporating a plurality of individual, flexible polymer magnetic strips in a double layer thickness between metallic front and back enclosure plates to provide a substantially continuous magnetic field across both front and back planar surfaces.

9 Claims, 1 Drawing Figure

MAGNETIC PALLET

FIELD OF THE INVENTION

This invention relates to permanent magnet attachment arrangements and, more particularly, to a magnetic pallet of industrial grade for generating a substantially continuous magnetic field sufficient to provide a magnetic holding force on both sides thereof and at all points thereacross.

BACKGROUND OF THE INVENTION

Permanent magnet devices for holding tools, nuts and bolts, and various other items in place for supposedly easy access have been commercially marketed. In one version of such magnetic tool holder, a one inch wide strip, of some two-four foot length, is attachable to a wall, or other non-metallic surface, and provides an opposing surface towards the user, onto which pliers, wrenches, calipers, scales, nuts and bolts are to be placed for supposed easy access. Experience has shown, however, that the arrangement of the tool, etc., along the strip is critical, in order that the magnetic attractive force will overcome the forces of gravity, in holding the item in place. Thus, it is not sufficient to just place a wrench, for example, in perpendicular alignment to the orientation of the magnetic strip, but that the wrench must be positioned so that most of its length extends downwardly from the strip. Otherwise—and not only with this particular example—the tool will be observed to fall to the ground, in defeating the intended purpose.

Although readily apparent that the magnetic attachment arrangement of this type is not usable where the magnetic tool holder is itself intended to be secured to a metallic surface—as, for example, at a machine bed—a second available strip configuration which permits such securement suffers the disadvantage that the permanent magnets employed are positioned at spaced intervals along the length of the strip, sometimes as much as four-six inches apart, and, also, exhibit a limited holding power which require criticality in the placement of the tool, or device, to be held. While this latter arrangement offers the advantage of portability, in that it can be removed from a machine bed easily, to be placed on the frame of an automobile on which a mechanic is then working, for example, the restricted holding power afforded contributes quite substantially to the tool, for example, actually falling, or, at the very least, presenting the fear of its falling—as is of prime concern if the magnetic attachment arrangement were to be used by a workman many stories up during a skyscraper construction where securement to a structural beam might be desired.

Clearly, although the "magnetic attractiveness" feature might be promoted in an advertising campaign for the home workshop mechanic, these devices are not generally usable in an industrial operative climate, where more serious effects could result than a mere falling of a pliers or scale to a floor, for the home craftsman to retrieve.

SUMMARY OF THE INVENTION

As will become clear hereinafter, the permanent magnet attachment arrangement of the invention is in the form of a magnetic pallet incorporating a plurality of individual, flexible polymer magnetic strips situated between metallic front and back enclosure plates. By employing metallic planar surfaces, magnetic forces of attraction will be created on either side of the construction, so as to permit a marked degree of portability, and securement to any metallic surface—such as a file cabinet, the insides of a military tank, the previously referred to machine bed, the automobile frame, etc. At the same time, as will be seen, keyway slots are also provided, to enable the workman to attach the pallet to a non-metallic surface, when working in such confines.

In making the magnetic pallet to be of industrial grade strength, the attachment arrangement of the invention employs the flexible polymer magnetic strips in a double layer thickness. Thus, according to a preferred embodiment of the present invention, two $\frac{1}{8}$ inch strips are employed, one atop the other, in similar magnetic orientation, which experience has found, provides a greater magnetic attraction on both front and back planar surfaces, greater than would be available if a single $\frac{1}{4}$ inch magnetic layer were used. Testing has further shown that, even though a multi-pole magnetic sheet might be used between front and back enclosure pallet plates, significantly improved performance follows from the use of aligning individual strips, of like polarity, alongside one another, in opposing polarity relationship, along the extent of the surface construction. As will be noted below, such construction permitted—again, in a preferred embodiment of the invention—the mere cutting, as with a scissor, approximate (and, therefore, non-critical) nine inch lengths of a one inch wide flexible polymer magnetic material in side-by-side placement in providing a surface area of some eight-one inches square, along which a substantially continuous magnetic field was generated.

As will also be noted—and, in accordance with a preferred embodiment of the invention—the necessary strength required in having the enclosure of an industrial grade classification is provided by having the front and back plates joining together in a "folded seam" relationship to foster a type of joining together, being pressed thereat together, and with further encapsulation being provided through an appropriate "spot-welding" procedure.

When fabricated in the foregoing manner, and as more completely described below, the magnetic pallet of the invention can be of a weight of the order of some three and one-half pounds, for easy portability, and of a sufficiently large surface area, so that no criticality need exist in the placement of the pliers, wrench, caliper, scale, nuts and bolts, etc. along the surface presented—a mere "slapping on" being all that is required. As will additionally be appreciated, ease of manufacture follows by "coding" the polymer magnetic material as it is being unraveled from its roll—or similarly "identified" beforehand, so that after cutting to the appropriate length, the individual strips can be aligned in either layer, in proper polarity orientation.

BRIEF DESCRIPTION OF THE DRAWING

These and other features of the invention will be more clearly understood from a consideration of the following description taken in connection with the single FIGURE of the drawings showing an isometric view, in partial cut-away form of a magnetic pallet constructed in accordance with a preferred embodiment of the overall manufacture.

DETAILED DESCRIPTION OF THE DRAWING

Figure 1:
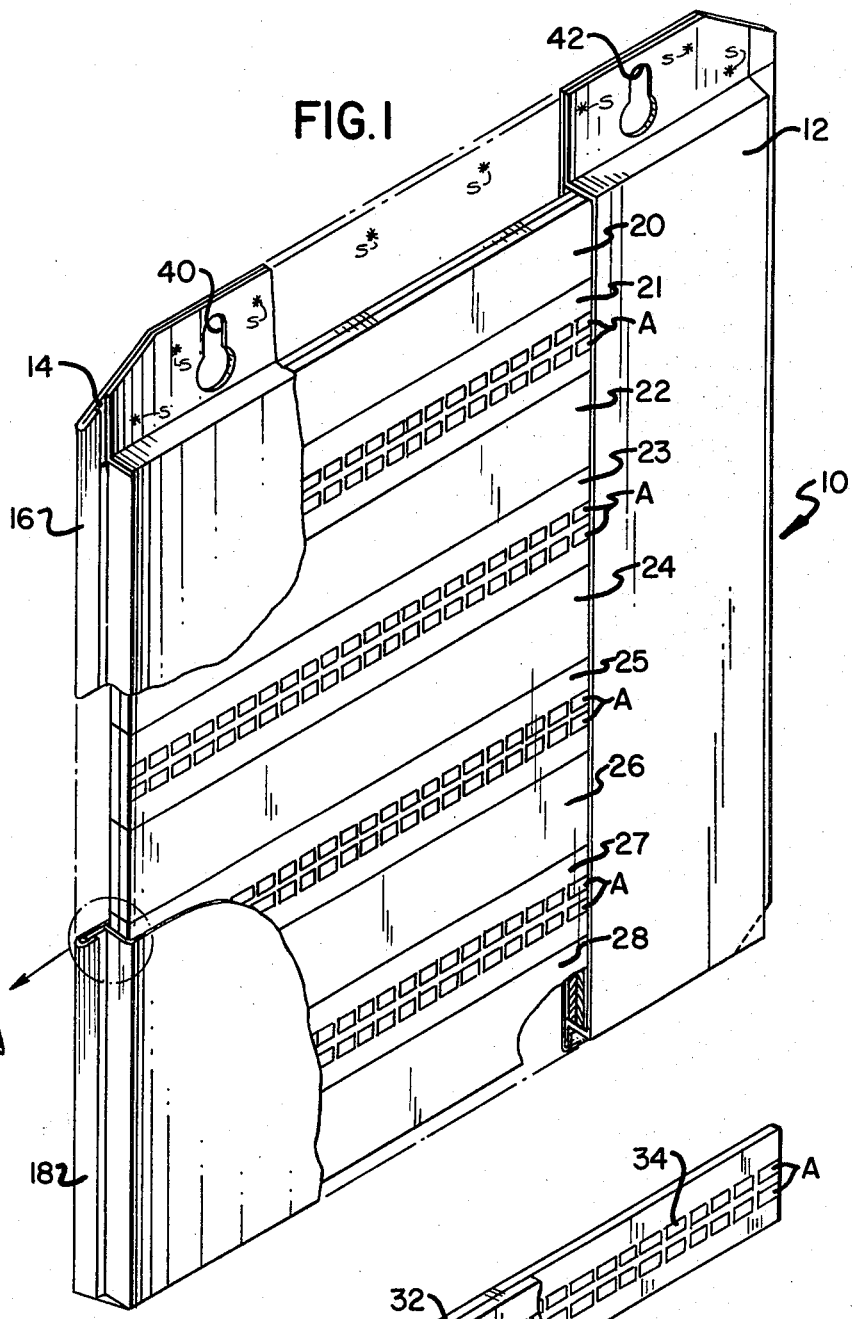
Figure 2:
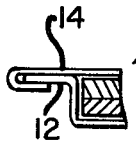
Figure 3:
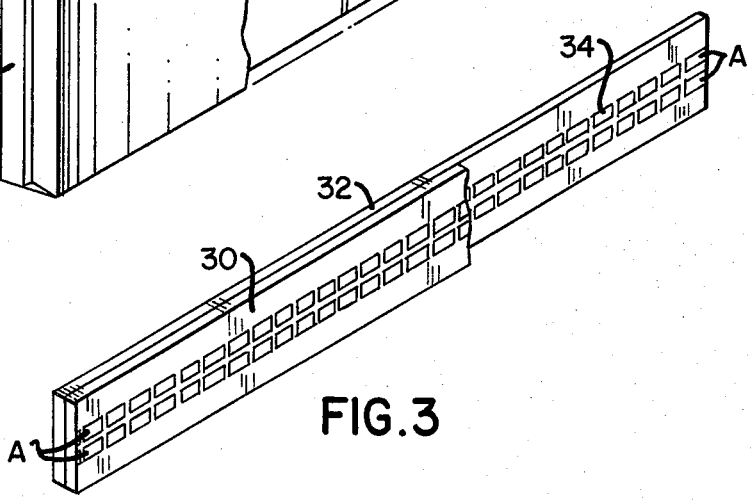

Referring to the drawing, the magnetic pallet 10 incorporates a front, or cover, plate 12, and a back, or base, plate 14, each of which are generally planar in construction. As shown at 16 and 18—and understood to be similarly existing at the right-hand side of the base plate, and at its bottom location, in addition—the side extremities are folded over to provide a seam, into which corresponding side and bottom tongue portions of the coverplate 12 are arranged to fit, in holding securement. With the arrangement shown in "blow-up" cutaway format at the inset alongside reference numeral 18, by fabricating both the cover and base plates of a galvanized sheet steel of #30 gauge thickness, the overall pallet construction will be of a depth of some ¼-5/16 inch with polymer strip thicknesses (as described below) of ⅛ inch each. It will be appreciated that after the coverplate 12 is fitted within the folded seam so formed, closure of the magnetic pallet at these locations—i.e. along the left and right-hand sides and at the bottom—can be obtained through a simple press operation.

Also shown in the drawing are two layers of individual flexible polymer magnetic strips 20–28 arranged in individual strip alignments, one adjacent the other. It will be appreciated that the selection of nine sections of one-inch polymer strip material is made with an eye towards an appropriate surface area intention, as compared with a pallet weight criteria in mind. (In this preferred embodiment, the individual strips 20–28 were cut to a non-critical length, approximating nine inches, and aligned in abutting relationship to provide an effective magnetic surface area of some eighty-one square inches.) As also indicated, the flexible strips are "coded"—as by any available marking—by its manufacturer—to signify the North (or South) pole of the magnetic material. In accordance with the invention, two layers of the polymer strips are employed, but with each having an identical polar relationship along the surface area, wherein adjacent individual strips are of opposite polarity, but where each individual strip is of the same polarity in both upper and lower layers. Therefore, a "North" pole of each layer strip will be in physical contact with the "South" pole of the layer in which it is in contact. Such arrangement of the two layers is shown at the insert at the right-hand side of the drawing, wherein the upper layer is denoted by the reference numeral 30, and the lower layer denoted at 32. In the construction illustrated, an "interrupted" red stripe 34 was employed as the coding identifier, laid down on only one side of the polymer material, with an understanding that the actual configuration for the identifier can take any configuration desired.

(In the construction of the magnetic pallet, the individual, flexible polymer magnetic strips are first loaded on the underside of the metallic coverplate 12, the tongue extensions of which are then inserted under the folded-over base plate 14, to be followed by the press operation to closure.) With the construction as so far described, there is then additionally provided a "spot welding", approximately at those positions labelled with the letter "S" to further enhance the structural integrity of the enclosure. A pair of keyway slots 40–42 may be provided in the cover and base plates 12, 14, either by a single "punch" step in the enclosure as fabricated, or individually in the separate plates during their respective manufactures.

In the fabrication of the magnetic pallet of the invention, it was found that the forces of attraction established with the construction set forth was significantly greater than if a single strip of polymer material were employed. Thus, two ⅛ inch strips were found to perform more attractively in providing a magnetic holding than a single ¼ inch material. Similarly, by utilizing individual strips alongside of one another, as described, the attractive forces generated were also determined to be greater than if a multi-pole magnetic strip were employed, in which alternative North-South poles would fall adjacent one another across the surface presented. By employing two ⅛ inch thick layer strips and a #30 gauge galvanized sheet steel material for the cover and base plates, a pallet of some ¼-5/16 inches thickness was obtained, which with the eighty-one square inch surface area described, exhibited a weight (3.5 pounds) which made the device very portable, yet at the same time offered a very substantial, continuous magnetic field both at the front and back surfaces, at substantially all points thereacross. Although thicker pallets might be employed, by utilizing polymer strips in excess of ⅛ inch each, the overall magnetic attraction would not be required in the holding of the various tools intended for use with the invention, but would significantly increase the overall weight. With the present invention, the magnetic pallet can very simply and easily be affixed to any metallic surface, through the magnetic field generated across the base plate 14, and could just be easily be secured to a non-magnetic surface through the feature of the keyway slots 40. Securement to a structural girder, to a machine bed, filing cabinet, automotive frame, military tank cockpit is but a simple matter, and the overall holding affect quite apparent. When marketed under the designation "Super Mag", the continuous magnetic field being generated along each surface throughout of the preferred double sided magnetic holding device of the invention carries quite clearly the advantages which follow from the non-critical manufacture and usage of the present invention, but with results far more intensive and meaningful than with the prior marketed versions of the non-industrial grade devices heretofore available.

While there has been described what is considered to be a preferred embodiment of the present invention, it will be readily appreciated by those skilled in the art that modifications can be made without departing from the scope of the teachings herein. For example, although the base and cover plates have been described as being fabricated both of a galvanized sheet steel material, it will be understood that other materials could be employed—and that even dissimilar materials, such as aluminum and galvanized sheet steel, could be used in front or back. Furthermore, it will be apparent that although specifically described in an arrangement to provide permanent magnetic attraction for tools employed by a workman, the magnetic pallet of the invention can also find use as a ferrous trap—not only in picking up metallic scraps and filings around a machine locale or in a tank of liquid to serve as a cleaner for picking up metallic debris—but that the pallet can also serve as a magnetic sheet separater. For at least such reasons, therefore, resort should be had to the claims appended hereto for a true understanding of the scope of the invention, of utilizing a magnetic pallet having within a plurality of individual, flexible polymer magnetic strips in a double layer thickness to provide substantially continuous magnetic fields across its front and back planar enclosing surfaces.

I claim:

1. Magnetic holding apparatus comprising:

first and second metallic plates; and a plurality of individual polymer magnetic materials in strip configuration interposed between said metallic plates, and in contact therewith to form an enclosure to generate a substantially continuous magnetic field across each of the surfaces of said plates;

with said individual strip materials each exhibiting North and South polarities across opposing surfaces thereof, and arranged in a double layer thickness in which a North polarity surface of one strip is positioned in contact with a South polarity surface of another strip, and wherein adjacent double layer thickness strips are aligned in opposite magnetic polarity relationship at the points of contact with said metallic plates;

whereby an enhanced magnetic circuit is produced and increased magnetic forces of attraction are generated across each surface of said enclosure forming plates.

2. The apparatus of claim 1 wherein said individual strips are of a flexible, polymer magnetic material.

3. The apparatus of claim 1 wherein said first and second plates are of similar metallic material composition.

4. The apparatus of claim 1 wherein said individual strips are coded to identify the opposing North and South polarity surfaces thereof.

5. The apparatus of claim 1 wherein said first metallic plate is arranged to provide a seam into which said second metallic plate is inserted in forming said enclosure.

6. The apparatus of claim 1 wherein said first plate includes aperture means for the hanging of said holding apparatus in the use thereof.

7. The apparatus of claim 1 wherein said polymer magnetic material strips are each of a one-eighth inch thickness.

8. The apparatus of claim 7 wherein said metallic plates are configured to provide an enclosure of nine inch by nine inch surface area.

9. The apparatus of claim 8 wherein nine polymer magnetic strips are interposed between said metallic plates, each of which is of a substantially one inch width and nine inch length.

* * * * *